US006531004B1

(12) United States Patent
Lenczowski et al.

(10) Patent No.: US 6,531,004 B1
(45) Date of Patent: Mar. 11, 2003

(54) WELDABLE ANTI-CORROSIVE ALUMINIUM-MAGNESIUM ALLOY CONTAINING A HIGH AMOUNT OF MAGNESIUM, ESPECIALLY FOR USE IN AVIATION

(75) Inventors: Blanka Lenczowski, Neubiberg (DE); Viktor Yelagin, Moskau Russland (RU); Rainer Rauh, Jetzendorf (DE); Valeri Zakharov, Moskau Russland (RU); Yuri Filatov, Moskau (RU)

(73) Assignee: EADS Deutschland GmbH, Ottobrunn (DE)

( * ) Notice: Subject to any disclaimer, the term of this patent is extended or adjusted under 35 U.S.C. 154(b) by 0 days.

(21) Appl. No.: 09/530,007

(22) PCT Filed: Aug. 21, 1998

(86) PCT No.: PCT/DE99/02492

§ 371 (c)(1),
(2), (4) Date: Oct. 18, 2000

(87) PCT Pub. No.: WO00/11232

PCT Pub. Date: Mar. 2, 2000

(30) Foreign Application Priority Data

Aug. 21, 1998 (DE) ..... 198 38 018

(51) Int. Cl.[7] ..... C22C 21/06

(52) U.S. Cl. ..... 148/439; 420/532; 420/533; 420/541; 420/542; 420/543; 148/440

(58) Field of Search ..... 148/439, 440; 420/532, 533, 541, 542, 543

(56) References Cited

U.S. PATENT DOCUMENTS 4,645,543 A 2/1987 Watanabe et al. ..... 148/2
5,620,652 A * 4/1997 Tack et al. ..... 420/532
5,624,632 A 4/1997 Baumann et al. ..... 420/544

FOREIGN PATENT DOCUMENTS

JP 63179040 7/1988

OTHER PUBLICATIONS

Database WPI Section Ch, Week 7710 Derwent Publications Ltd., XP–002127941, p. 23, AN 1977–17364Y & JP52011143 A (Nippon Light Metal Res Lab).
Database WPI Section Ch, Week 9808 Derwent Publications Ltd. XP002127942 & RU 2081934 c (Light Alloys Inst Stock Co).
Cherkasov V.V., et al. "Special Fearutes of the Structure Formation and Properties . . . " *Metal Science and Heat Treatment*.
Patent Abstracts of Japan of 63248593 of Octover 14, 1998.
Patent Abstracts of Japan of JP 63–179040 Dated: Jul. 23, 1988.
Brockhaus der Naturwissenschaften und der Technik, p. 161 (1965) F.A. Brockhaus Wiesbaden.
Gschneidner, Jr., K.A. "A critical Review of the Alloy Systems of the Rare Earth, Scandium and Yttrium Metals," in Rare Earth Alloys (1961) pp XI & 12.

* cited by examiner

*Primary Examiner*—George Wyszomierski
*Assistant Examiner*—Janelle Combs Morillo
(74) *Attorney, Agent, or Firm*—Ladas & Parry

(57) ABSTRACT

Weldable, high-magnesium-content aluminum-magnesium alloy consisting of at least 5–6% w/w magnesium (Mg), 0.05–0.15% w/w zirconium (Zr), 0.05–0.12% w/w manganese (Mn), 0.01–0.2% w/w titanium (Ti), 0.05–0.5% w/w of one or more elements from the scandium group and/or terbium (Tb), wherein at least scandium (Sc) is included, 0.1–0.2% w/w copper (Cu) and/or 0.1–0.4% w/w zinc (Zn), along with aluminum (Al), and unavoidable contamination does not exceed 0.1% w/w silicon (Si).

6 Claims, No Drawings

WELDABLE ANTI-CORROSIVE ALUMINIUM-MAGNESIUM ALLOY CONTAINING A HIGH AMOUNT OF MAGNESIUM, ESPECIALLY FOR USE IN AVIATION

The invention relates to a weldable, corrosion-resistant, high-magnesium-content aluminum-magnesium alloy, which contains a ternary aluminum-scandium-zirconium phase as the essential component. Such an alloy is known from U.S. Pat. No. 5,624,632, for example, and is of interest above all for applications in aeronautics due to its low density, high strength and corrosion resistance. Adding rare earth or rare earth-like elements generates dispersoids in the aluminum-magnesium alloy, which produce a higher strength and corrosion resistance according to the above US patent. The above US patent makes no statement as to the weldability of such an alloy.

The object of this invention is to provide a weldable, corrosion-resistant, high-magnesium-content aluminum-magnesium alloy, which is at least as good as the known alloy in terms of strength and corrosion behavior, and exhibits a high recrystalization threshold to go along with a good weldability. This object is achieved by an aluminum-magnesium alloy according to claim 1.

In comparison to the known alloy, this new alloy exhibits above all a distinctly lower manganese content, wherein an improved corrosion resistance was surprisingly found, primarily in the sensitized state of the parts made out of this alloy, e.g., when cold-formed parts are subjected to an elevated temperature over a prolonged period. It is assumed that these positive properties are determined primarily by the ratio of manganese to scandium. An improved corrosion resistance is observed at a ratio of Mn to Sc<2. Along with acting as a grain growth inhibitor, the titanium content not present in the known alloy helps to increase strength, since titanium can replace the zirconium in the ternary Al—Sc—Zr phase, wherein the solubility of titanium is lower than that of zirconium however.

The addition of Cu and/or Zn increases the strength, which can be traced back to the known high strength of the Al—Cu or Al—Zn phase. The respective upper concentration limits are selected to prevent the Cu from diminishing the weldability, and the Zn from diminishing the corrosion resistance.

A particularly strong and corrosion-resistant alloy contains at least 0.15% w/w scandium. A component from the lanthanide series is preferably added in amounts ranging from 0.05 and 0.35% w/w, wherein this range relates to the total mixture when using a lanthanide mixture. The alloy tolerates silicon contamination of up to 0.1% w/w; primarily the dynamic properties deteriorate above this level.

A particularly strong and corrosion-resistant alloy contains at least 0.15% w/w scandium. Lanthanidene is preferably added in amounts ranging from 0.05 and 0.35% w/w, wherein this range relates to the total mixture when using a lanthanidene mixture. The alloy tolerates silicon contamination of up to 0.1% w/w; primarily the dynamic properties deteriorate at above this level.

What is claimed is:

1. Weldable, corrosion-resistant, high-magnesium content aluminum-magnesium alloy comprising a ternary aluminum-scandium-zirconium phase and consisting essentially of 5 to 6% by weight magnesium (Mg), 0.05 to 0.15% by weight zirconium (Zr), 0.05 to 0.12% by weight manganese (Mn), 0.01 to 0.2% by weight titanium (Ti), 0.05 to 0.5% total by weight of scandium (Sc), terbium (Tb), and optionally at least one additional element selected from the group consisting of the lanthanide series, wherein scandium (Sc) and terbium (Tb) are present as mandatory elements, with said terbium Tb) replacing part of the scandium content such that the amount of terbium (Tb) is larger than the replaced part of the scandium content, and at least one element selected from the group consisting of 0.1 to 0.2% by weight copper (Cu) and 0.1 to 0.4% by weight zinc (Zn), the balance being aluminum and unavoidable contaminants not exceeding 0.1% by weight silicon.

2. An aluminum-magnesium alloy as claimed in claims 1, wherein manganese (Mn) and scandium (Sc) are present in amounts to provide a ratio thereof of less than 2.

3. An aluminum-magnesium alloy as claimed in claim 1, wherein scandium is present in an amount of at least 0.15% by weight.

4. An aluminum-magnesium alloy as claimed in claim 1, wherein at least one element of the lanthanide series is present in an amount of 0.05 to 0.35% by weight.

5. An aluminum-magnesium alloy as claimed in claim 4, wherein said lanthanide series element is cerium (Ce), neodymium (Nd), europium (Eu), gadolinium (Gd), dysprosium (Dy), holmium (Ho) or erbium (Eb).

6. A welded component of an aircraft consisting of an alloy as claimed in claim 1.

* * * * *